US005454289A

United States Patent [19]

Bacon et al.

[11] Patent Number: 5,454,289

[45] Date of Patent: Oct. 3, 1995

[54] LIGHTWEIGHT HIGH L' ELECTROMAGNETIC LAUNCHER

[75] Inventors: James L. Bacon; Richard L. Laughlin; John H. Price, all of Austin, Tex.

[73] Assignee: Board of Regents, The University of Texas System, Austin, Tex.

[21] Appl. No.: 52,047

[22] Filed: Apr. 21, 1993

[51] Int. Cl.[6] ..... F41B 6/00

[52] U.S. Cl. ..... 89/8; 89/16; 124/3

[58] Field of Search ..... 42/76.02; 89/8, 89/15, 16; 124/3

[56] References Cited

U.S. PATENT DOCUMENTS

| | | | |
|---|---|---|---|
| 475,071 | 5/1892 | Willson | 89/16 |
| 4,846,911 | 7/1989 | Tackett et al. | 89/8 |

OTHER PUBLICATIONS

J. P. Barber, "The Acceleration of Macroparticles and a Hypervelocity Electromagnetic Accelerator," The Australian National University, Department of Engineering Physics, Research School of Physical Sciences, Canberra, A.C.T., Mar., 1972.

R. L. Laughlin et al., "Design, Analysis, and Fabrication of Two Lightweight High L' Railguns," (6 pages), Center for Electromechanics, The University of Texas at Austin, Texas, Presented at the 6th Symposium on Electromagnetic Launch Technology, Austin, Texas, Apr. 28–30, 1992.

S. B. Pratap et al., "A Compulsator–Driven Rapid–Fire Railgun System," pp. 740–743, The University of Texas at Austin, Texas, presented at the 5th IEEE Pulsed Power Conference, Arlington, Va., Jun. 10–12, 1985.

*Primary Examiner*—Stephen C. Bentley

*Attorney, Agent, or Firm*—Arnold, White & Durkee

[57] ABSTRACT

Methods and apparatus related to design and construction of lightweight and mobile railgun barrels having high L' (inductance per unit length). The barrels comprise stacked metallic annular laminations in combination with pre-stressed tension elements to add radial and longitudinal stiffness. Laminations have elongated annular shapes to accommodate a plurality of longitudinal rails within the barrel, and the lamination shape is optimized to contain radial forces (tending to spread the rails) associated with the launching of railgun projectiles. Longitudinal stiffness is obtained from tension elements spirally wound around the barrel at a preferred angle with the barrel longitudinal axis. Radial stiffness is obtained by injecting a settable plastic fluid between barrel laminations and internal (bore) components, the latter being held as a subassembly with a longitudinal shrink tube.

9 Claims, 2 Drawing Sheets

LIGHTWEIGHT HIGH L' ELECTROMAGNETIC LAUNCHER

The invention was made with Government support and the Government has certain rights in the invnetion.

BACKGROUND

1. Field of the Invention

The invention relates to methods and apparatus for maintaining rail spacing and minimizing rail curvature in electromagnetic launchers (railguns).

2. Design Considerations for Mobile Railguns

Railguns use electromagnetic force to accelerate a projectile which completes an electrical path incorporating two or more substantially parallel conducting rails. Peak electrical currents exceed 3,000,000 amperes (3.0 MA) in certain guns, and the resulting magnetic pressure may result in a total (radial) force acting to separate the rails in excess of 90 kips/in. Actual movement of the rails, however, should not be so great that electrical contact is lost or substantially reduced between either rail and the projectile.

Should rail-projectile contact be lost, the resulting plasma contact would generally have a higher associated voltage drop than a metal-to-metal contact, thus reducing current flow and the amount of magnetic force applied to the projectile. Thus in stationary railguns, high-strength (and relatively heavy) structural members are employed to provide the substantial restraining forces needed to prevent rail separation. The required structural mass may be reduced somewhat through the use of preloaded elements (e.g., ceramic rail supports heavily preloaded by an outer steel shell), but the resulting railgun barrel is still too heavy for mobile applications. Further weight reductions require replacement of ceramic rail supports with members having lower preload requirements, and replacement of a steel outer shell with a lighter preloading member.

Weight reductions in structural elements must not, however, compromise the stiffness required to keep the railgun barrel straight within narrow tolerances. This is because the muzzle velocity of railgun projectiles may range from two to ten kilometers per second. Thus, the rails and their supporting structures comprising the railgun barrel must have the requisite stiffness to avoid droop or sag which would impair performance by deviating the projectile path from a straight line. If the railgun is to be mobile, the barrel must also be sufficiently light and stiff to allow the use of conventional recoil and aiming mechanisms (i.e., the barrel should be stiff enough to withstand abrupt changes in longitudinal acceleration and high slew rates).

Another aspect of railgun design is maximization of muzzle energy, which for a given rail current is approximately linearly related to the inductance per unit length (L') of the rails within a railgun barrel. L'tends to be reduced by the presence of metal rail supports or any other electrical conductor near the rails if substantial eddy currents can be induced parallel to the longitudinal axis of the barrel. Ceramic rail supports are thus theoretically superior to metal supports because they are electrical insulators, but the large preload requirement needed to prevent cracking of the insulators is not compatible with weight constraints in a mobile railgun.

As a substitute for ceramic rail supports, stacked iron or steel laminations have been used to fore railgun barrels and to provide needed radial support for the rails. Laminated metal rail supports have less longitudinal stiffness than solid metal, but eddy current losses in the laminations are substantially smaller than such losses would be in comparable solid metal supports if the laminations are sufficiently thin and electrically insulated from one another.

To increase longitudinal stiffness, stacked laminations are bonded together (preferably by the insulating material separating them from each other and from the rails). Without additional support, however, bonded laminations have limited resistance to transverse forces (e.g., due to gravity or barrel inertial forces) which tend to distort the railgun barrel along its longitudinal axis (which substantially parallels or is coincident with the direction of projectile travel). Hence, laminations have heretofore been used in railguns having fixed mounts where longitudinal railgun barrel stiffness could be provided by additional (fixed) structural systems (e.g., longitudinal bolts). No design for railgun barrels comprising stacked laminations and having the strength, stiffness and lightness required for mobile applications has been demonstrated or proposed.

SUMMARY OF THE INVENTION

The present invention substantially overcomes shortcomings in prior railgun barrels and methods for making them, relating particularly to railguns which are sufficiently strong, lightweight and stiff for mobile applications. Each railgun barrel of the present invention comprises a plurality of substantially parallel longitudinal rails disposed within and substantially parallel to the longitudinal axis of a hollow cylindrical stack of annular steel laminations. At least two longitudinal rails are disposed to form a portion of the railgun barrel bore, such rails being separated throughout their length by longitudinal insulating spacers. In preferred embodiments, the longitudinal rails and longitudinal spacers are disposed alternately and symmetrically around a longitudinal void, the void comprising the barrel bore, and the rails and spacers collectively forming the bore wall.

Each lamination (and each lamination stack) has inner and outer contours, and each lamination is thin enough to substantially inhibit eddy current losses and the associated undesirable reduction of L'for rails which are longitudinally oriented adjacent to the inner contour of the lamination stack.

Laminations are further described as planar structures having substantially parallel first and second sides, and an edge which comprises the outer contour of each lamination. Entirely enclosed by the outer contour is an inner contour which defines a center void portion lying within the plane of each lamination. Inner and outer contours are continuous, and when a plurality of laminations is stacked, the inner contours combine to form a cylinder having an outer surface, an inner surface, and a longitudinal axis substantially parallel to or colinear with the railgun bore. Longitudinal rails and insulating spacers are preferably disposed adjacent to said inner surface. The cylinder wall thickness at any point corresponds to the distance separating the inner and outer contours of the lamination at that point.

The outer surface of a lamination stack generally lies within the (preferably) cylindrical outer surface of the railgun barrel, the intervening space being substantially occupied by longitudinal preload elements laid adjacent to the lamination stack. Radial preload elements, as explained below, are preferably applied adjacent to the lamination stack inner surface in railgun barrels of the present invention. Hence, the presence of radial preload elements does not substantially alter the barrel outer surface.

Examples of preload elements include prestressed longitudinal tension preload elements (e.g., S-glass fibers) coupled (bonded) to the outer surface of lamination stacks with a predetermined tension level. The tension elements are spirally wound around the lamination stack at an angle between about 0° and 11° to the longitudinal axis of the lamination stack. Requirements for such longitudinal tension preload elements in rail gun barrels constructed according to the present invention include relatively light weight and sufficiently high electrical resistivity (i.e., the tension elements should effectively be electrical insulators).

Longitudinal preload elements are ideally applied substantially parallel to the longitudinal axis of the barrel, but in practice they must either be bound to the barrel by hoop windings (the planes of which are substantially perpendicular to the longitudinal axis), or be wound at a small angle $\alpha$ to the longitudinal axis to prevent sagging away from the lamination stack. Because hoop windings impose a weight penalty while contributing nothing to longitudinal stiffness, winding at an angle $\alpha$ to the longitudinal axis is preferred. In railgun barrels made according to the present invention, the preferred angle $\alpha$ is about 6°.

Longitudinal preload elements in preferred embodiments of railgun barrels made according the present invention comprise S-glass fibers applied under tension to the lamination stack at the angles noted above. The longitudinal components of tension forces in each element combine to yield the total preload force applied to the lamination stack. If, during application of the longitudinal tension preload elements, the lamination stack is simultaneously compressed, the subsequent release of such compression adds to the tension force applied to the longitudinal tension elements during winding, thus resulting in a larger total preload.

Laminations are insulated from each other and from the rails by, e.g., nonconducting epoxy or composite material layers. Individual laminations are substantially flat and may be stamped or cut from, for example, half hard type 301 stainless steel stock. When stacked according to the present invention, perpendiculars to flat portions of each lamination are substantially parallel to the longitudinal axis of the railgun barrel. Each lamination completely encloses a thin section of the barrel bore transverse to the longitudinal axis and containing a thin section of each longitudinal rail and each insulating longitudinal rail spacer. Rail spacers, together with the rails, comprise the bore components of the railgun barrel, defining the bore cross-sectional shape and acting to prevent electrical contact with the projectile except through the intended rails.

Laminations must have sufficient radial stiffness to counter the magnetic pressure acting to increase separation of the rails when a projectile is fired. Radial lamination stiffness in relation to weight may be optimized by making portions of each lamination which extend between the rails as straight as possible, consistent with the requirement that such portions enclose the bore components (specifically, the insulating rail spacers). Such a configuration results in an elongated substantially hexagonal lamination shape.

To prevent forces tending to separate the rails from opening gaps between the rails and longitudinal insulating spacers forming the bore cross-section (i.e., to prevent further elongation of the above elongated hexagonal shape), the bore components (i.e., rails and longitudinal spacers) are preloaded in compression by injection of a settable plastic fluid material (e.g., an epoxy resin) under a predetermined pressure of, preferably, 2,000 to 4,000 psi between the bore components and the lamination stack. Pressure is then maintained on the plastic material until it cures (sets) to a solid form and the compressive preload on bore components becomes permanent. Properly applied, such a radial preload substantially prevents leakage of contaminates to the region between the bore and the interior wall of the lamination stack during firing of the railgun. If not prevented, such leakage can eventually result in electrical short circuit paths between the rails.

Radial preloading is facilitated in construction of railgun barrels according to the present invention if the bore components are assembled outside of the lamination stack and temporarily held in fixed positional relationship with a longitudinally applied shrink-fit plastic tube. A sleeve comprising S-glass in a 45° weave is then slipped over the plastic tube, after which the sub-assembly comprising the rails, longitudinal insulating spacers, longitudinal shrink-fit tube and S-glass sleeve is then inserted into the lamination stack cylinder and the ends sealed to allow injection of the settable plastic material between the S-glass sleeve and the inner wall of the lamination stack. During this injection, the plastic tube prevents extrusion of the injected material between the rails and longitudinal insulating spacers, thus preserving the designed bore cross-section and allowing application of sufficient injection pressure to obtain satisfactory radial preload of the bore components. The S-glass sleeve acts to stabilize the settable plastic material and tends to prevent extrusion of the material under high pressure.

DETAILED DESCRIPTION

Abbreviations kips/in—1,000 pounds force per inch

L'—inductance per unit length (henrys)

MA—1,000,000 amperes psi—pounds force per square inch

Figure 1:
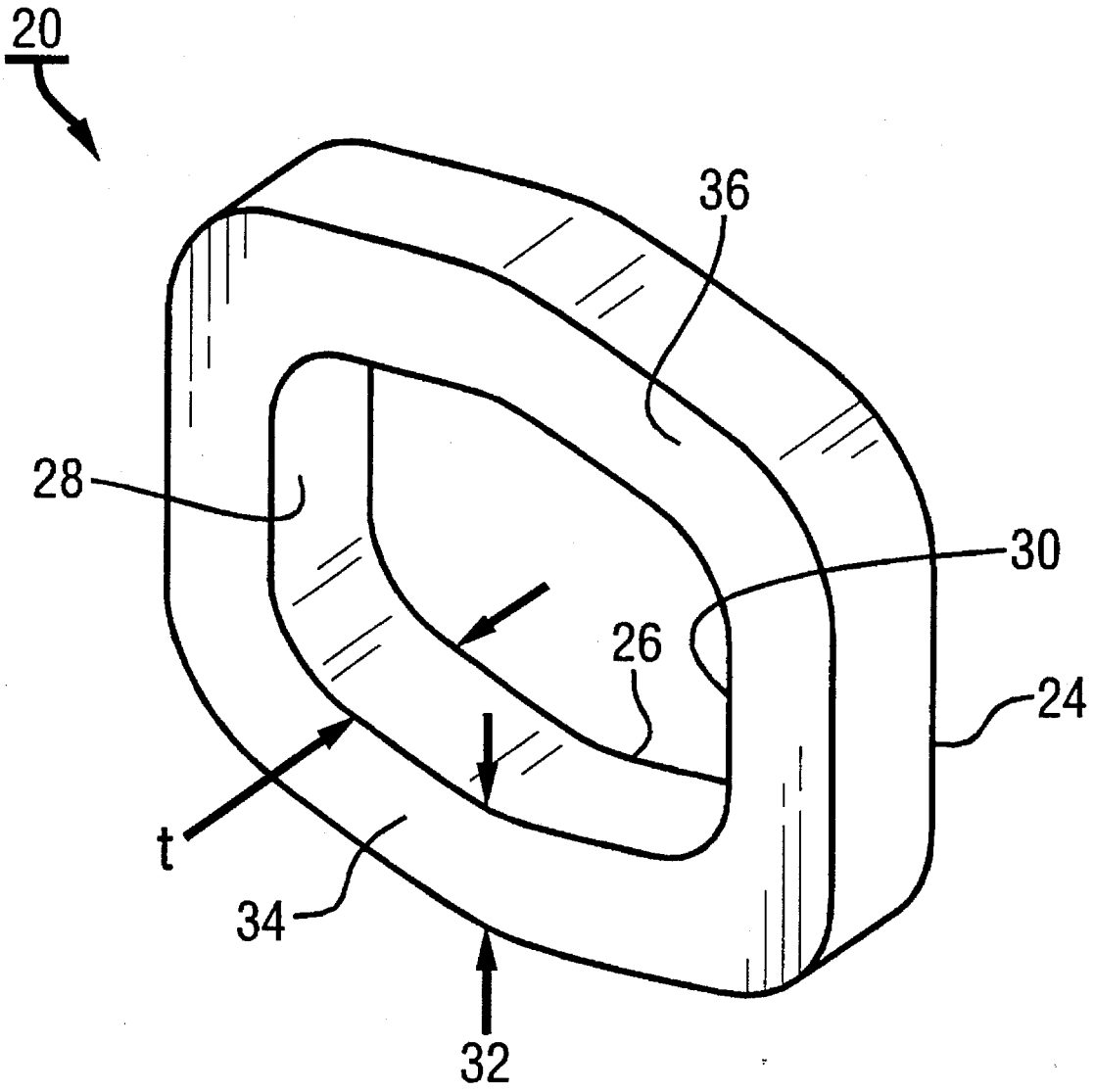
FIG. 1 schematically illustrates the structural features of a lamination as used in the present invention.

FIG. 1 schematically illustrates a typical lamination 20, the lamination stack 64 (shown in FIG. 2) comprising a plurality of laminations 20 in the present invention. The longitudinal axis of the lamination stack will in general be substantially parallel to the longitudinal axis of a railgun barrel made therewith. The preferred thickness $\alpha$ of laminations is a function of the frequency of eddy currents likely to be induced therein, thinner laminations being preferred for higher frequencies. An estimate of the applicable frequency for a particular lamination may be obtained by dividing the velocity of the railgun projectile (as it passes the lamination in question) by the projectile length. It is apparent that, since projectile velocity is least near the railgun breech and greatest near the muzzle, preferred lamination thickness in general varies along the longitudinal axis of the lamination stack which comprises the railgun barrel. If a single thickness lamination is preferred, its thickness is chosen with regard for the highest frequency eddy currents expected in the railgun. An acceptable thickness $\alpha$ for laminations 20 in railguns made according to the present invention (i.e., having a projectile length of approximately 10 inches and a maximum velocity of approximately 10 km/sec) is about 0.050 inches.

Laminations are fabricated from material that does not degrade the electromagnetic performance of the electromagnetic launcher (railgun) by reducing the electromagnetic field strength between the rails. This is achieved by selecting a material which is nonmagnetic, and a stack of nonmagnetic laminations comprising a railgun barrel acceptably limits eddy current effects if the laminations 20 have appropriate thickness t as described above, and are insulated from one another. A suitable lamination material for railguns made according to the present invention is half hard type 301 stainless steel, and acceptable insulation is provided by a fluid mixture of epoxy binder and fiberglass applied to all surfaces of lamination 20. Other suitable insulation may comprise varnish, nonconducting paint, or a metal oxide layer.

The outer contour 24 of the lamination 20 is selected to enhance the filament (tension element) spiral winding process while minimizing mass. Since the tension element overwrap is directly onto the lamination stack, there must be no abrupt changes in the outer contour 24, and no areas which will allow the filament to become slack. Filament tension during winding is predetermined to reduce sag, increase packing factor, and preload the lamination stack. Tension is applied by a friction brake retarding a roller over which the filament passes. Filament tension is set as high as possible without breaking filaments as they are applied. For example, a nominal tension force of about 20,000 psi is preferably applied to a filament comprising S-glass strands.

The inner contour 26 of the lamination 20 is such that the rails (preferably two rails, for the lamination of FIG. 1) will mechanically couple to the lamination. For the elongated hexagonal lamination shape of FIG. 1, the areas of intended rail coupling are the internal contour areas 28, 30. The sides 34, 36 extending between the rail coupling regions 28, 30 must be as straight as possible to effectively contain the forces exerted by the rails on regions 28, 30. Lamination wall width 32–32 must be sufficiently large so that maximum allowable stresses are not exceeded in the wall material.

Figure 2:
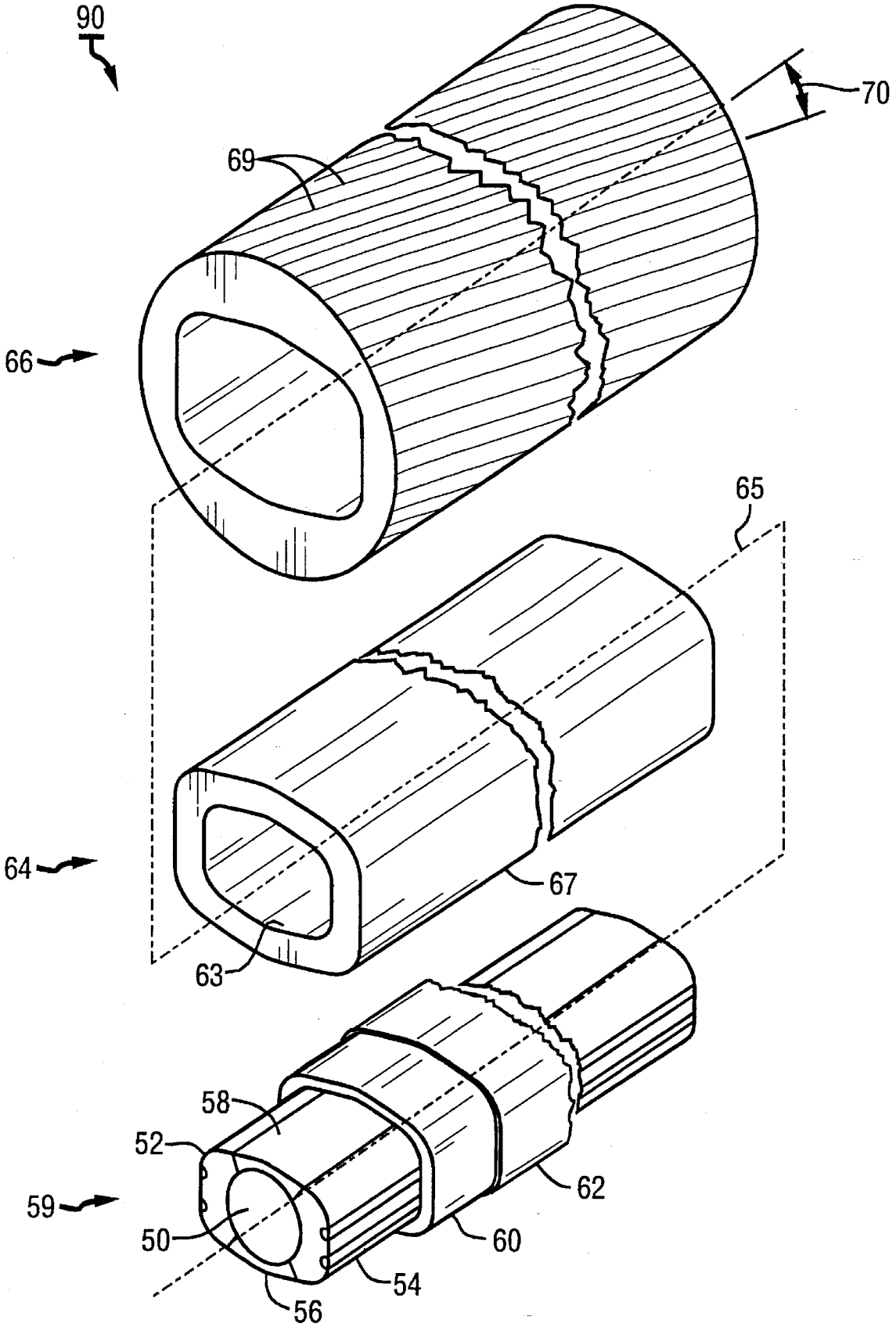
FIG. 2 schematically illustrates an exploded view of a railgun barrel embodying features of the present invention.

FIG. 2 schematically illustrates the major components of a railgun barrel 90 made according to the present invention. The lamination stack 64 is compressed by a predetermined force applied along its longitudinal axis 65. A plurality of tension elements 66 are then bonded together and collectively bonded to the outer surface 67 of lamination stack 64, individual tension elements 69 being spirally wound over the outer surface 67 at an angle 70 between about 0° and 11°, preferably about 6°. Individual tension elements preferably comprise a relatively light-weight, substantially electrically nonconducting flexible elements (e.g., S-glass fibers) which may be bonded to each other and to lamination stack 64 while avoiding the appearance of slack in the elements. Suitable bonding material to adhere individual tension elements 69 to each other, and to adhere a plurality of tension elements 66 to the outer surface 67 of lamination stack 64, would be, e.g., an epoxy resin.

Longitudinal rails 52 and 54 are coupled to longitudinal insulating spacers 56 and 58 to form the bore 50 as a bore component assembly 59. The bore component assembly 59 is inserted within a longitudinal shrink tube 60, the shrink tube 60 preferably comprising TEFLON. After shrinking of the shrink tube 60, an S-glass 45° weave sleeve 62 is drawn over the shrunken shrink tube 60. Following this, the bore component assembly 59, together with the shrunken shrink tube 60 and the S-glass 45° weave sleeve 62 are inserted simultaneously within lamination stack 64. One end of shrunken shrink tube 60 is then sealed circumferentially to the inner surface 63 of lamination stack 64 (e.g., with epoxy). Following this, the other end of shrunken shrink tube 60 is adapted to seal around a pressure injector (not shown) which injects settable plastic fluid (not shown) into the space between the inner surface 63 and the shrunken shrink tube 60 using a preferred predetermined pressure. This pressure is held until the plastic fluid cures (sets) and becomes a solid form which continues to exert a (preloading) radial compressive force on the longitudinal rails 52, 54 and the longitudinal insulating spacers 56, 58.

What is claimed is:

1. A railgun barrel having a bore, said barrel comprising a plurality of stacked steel laminations, each stack having a substantially hollow cylindrical form with an outer surface, an inner surface, a stack longitudinal axis, a stack transverse cross-section perpendicular to said stack longitudinal axis, and an inner contour of said stack transverse cross-section, said inner contour being noncircular;

a plurality of longitudinal rails, disposed substantially parallel to said stack longitudinal axis and adjacent to said inner surface;

a plurality of longitudinal insulating spacers disposed substantially parallel to said stack longitudinal axis and adjacent to said longitudinal rails and said inner surface, said rails and spacers disposed alternately to form the railgun barrel bore;

a radial preload element coupled to said inner surface, said longitudinal rails, and said longitudinal insulating spacers; and longitudinal tension preload elements coupled to said outer surface and disposed at an angle of between about 0° and 11° to said stack longitudinal axis.

2. The railgun barrel of claim 1, said stack inner contour being an elongated hexagonal shape.

3. The railgun barrel of claim 1, said steel laminations comprising half hard type 301 stainless steel.

4. The railgun barrel of claim 1, said longitudinal tension preload elements being disposed at an angle of about 6° to said stack longitudinal axis.

5. The railgun barrel of claim 1, said radial preload element comprising epoxy resin.

6. The railgun barrel of claim 1, said longitudinal tension preload elements comprising S-glass.

7. The railgun barrel of claim 1 comprising two longitudinal rails.

8. The railgun barrel of claim 7, further comprising two longitudinal insulating spacers separating said two longitudinal rails.

9. The railgun barrel of claim 1, said radial preload element comprising a settable plastic fluid.

* * * * *